United States Patent [19]

Brivio et al.

[11] 4,382,644

[45] May 10, 1983

[54] BEARING DEVICE FOR SLIDING PANELS, PARTICULARLY FOR A PIECE OF FURNITURE

[75] Inventors: Onorato Brivio, Meda; Attilio Brivio, Figino Serenza, both of Italy

[73] Assignee: Brivio Industria Mobili di Brivio Onorato e Attilio S.d.f., Novedrate, Italy

[21] Appl. No.: 173,657

[22] Filed: Jul. 29, 1980

[30] Foreign Application Priority Data

Aug. 2, 1979 [IT] Italy ..... 24859 A/79

[51] Int. Cl.[3] ..... A47B 88/00; E05C 19/06

[52] U.S. Cl. ..... 312/334; 312/319; 312/322; 312/325

[58] Field of Search ..... 312/334, 330 R, 322, 312/242, 257 A, 257 SM, 319, 325

[56] References Cited

U.S. PATENT DOCUMENTS

| | | | |
|---|---|---|---|
| 554,163 | 2/1896 | Wollerman | 312/334 |
| 967,609 | 8/1910 | Campbell | 312/255 |
| 1,200,694 | 10/1916 | Beach | 312/325 |
| 1,380,222 | 5/1921 | Lichtenberg | 312/325 |
| 2,492,697 | 12/1949 | Higley | 312/322 |
| 2,763,527 | 9/1956 | Berger | 312/325 |
| 2,888,308 | 5/1959 | Devine et al. | 312/322 |
| 2,961,240 | 11/1960 | Ablett | 312/322 |
| 3,063,774 | 11/1962 | Silver | 312/322 |
| 3,081,138 | 3/1963 | Stebbins | 312/325 |
| 3,854,784 | 12/1974 | Hunt et al. | 312/319 |
| 4,180,298 | 12/1979 | Borgerson, Jr. | 312/242 |

*Primary Examiner*—Victor N. Sakran

*Attorney, Agent, or Firm*—Bucknam and Archer

[57] ABSTRACT

A bearing device for sliding panels particularly for furniture is described which comprises: two sections (4) fixed at one end thereof at the upper cross-bar and at the other end thereof at the lower cross-bar of the piece of furniture respectively, by hinge means; a telescopic sliding guide (5) fixed to each of the sections (4) on the side where the panel (2) is located, the panel being slidably fixed to the telescopic guide (5). Means (11,13) for stopping the rotations of the sections (4) are placed substantially at the end of the sections which is opposite to the hinge means. The device also comprises elastic return means (22) connected at one end to a fixed portion (20) of the piece of furniture and, at the other end, to a pin (24) set in the sections (4). The elastic means are adapted to place and retain the panels (2) in their closed and open positions respectively. The elastic means comprise a spring (22), a small shaft (17) supporting the spring, the shaft being rotatably set in a plane substantially parallel to the plane of rotation of section (4). The shaft has one end rotatatively connected around a portion (20) of a pin (11), perpendicular to the plane of rotation of the section (4), the other end being slidingly set within a pin (24), parallel to the pin (11). The pin (11) is rotatively set around its longitudinal axis in the sections (4).

6 Claims, 8 Drawing Figures

BEARING DEVICE FOR SLIDING PANELS, PARTICULARLY FOR A PIECE OF FURNITURE

The present invention relates to a bearing device for sliding panels. More particularly, the invention relates to sliding panels for furniture.

Sliding panels are known in furniture, particularly in wardrobes, lockers and closets, but the known sliding panels present a series of drawbacks, which do not make their use advisable. At present the sliding panels require slide guides which are applied to the inner lower and upper border of the piece of furniture, and with the panels moving on these guides one parallel to the other. This shape presents the known undesirable disadvantages that infiltration of dust in the interior of the piece of furniture is likely to occur, caused by the unavoidable play between the panels, which are not held at all against the space which they close, but freely slide on the respective guides.

The space between the panels may even increase because of the wear with time both of the slide guides and of the parts of the panels which are in touch with the same guides. The furniture, and in general the spaces, closed by sliding panels of this kind, lack the necessary qualities for good maintenance of the articles placed in the furniture or in the space they are intended to close.

Another drawback of the sliding panels of the type discussed hereinabove is due to the presence of several parallel guides, on which the panels slide, which require the depth of the furniture to be greater than necessary. Particularly when there are problems for the lack of space, this feature forces the consumer to give up the purchase of a piece furniture, and to buy a common piece of furniture with hinged panels.

Another substantial drawback of the sliding panels of the above mentioned type, consists of the fact that for furniture with several panels, it is difficult to dispose the panels in such a manner that the opening of one panel does not interfere with the opening of another panel. In any event, while in furniture with two panels, every panel slides on its own guide, in a piece of furniture with more than two panels, it is necessary to place more than one panel on the same guide with evident drawback for the user.

One object of the present invention resides in a bearing device for a sliding panel, particularly for a piece of furniture, which permits to eliminate the above mentioned disadvantages.

Another object is to provide a bearing device of a sliding panel, by means of which every panel, in the closed position, is applied and held against the border of the space, closed by the same panel, thus avoiding entirely any infiltration of dust into the interior of the space being closed.

A further object of the present invention is to provide a bearing device for a sliding panel by means of which every panel utilizes, for its sliding, its own means, without interfering with the sliding of other panels. This feature is particularly important for a piece of furniture with several panels.

Still another object of the bearing device according to the present invention is the elimination of the plurality of slide guides of the known panels, so that the effective space of the piece of furniture is reduced.

The bearing device of sliding panels according to the present invention includes: two bearing sections hinged at each end, respectively to the upper and lower cross-bar of the piece of furniture; a telescopic sliding guide applied to each of said sections from the side in which the panel is located, the latter being fixed to said telescopic guide for its sliding; means for stopping the rotations of the sections, substantially disposed at the end of these sections opposite to the hinge pivot; elastic return means connected at one side, to a fixed portion of the piece of furniture, and, at the other side, to a pin carried by the support bearing, for the purpose of keeping the panel in its closed and open position.

The characteristics and the advantages of the device according to the present invention will result evident from the following detailed description of a non-limiting embodiment, with reference to the attached figures, of which:

Figure 1:
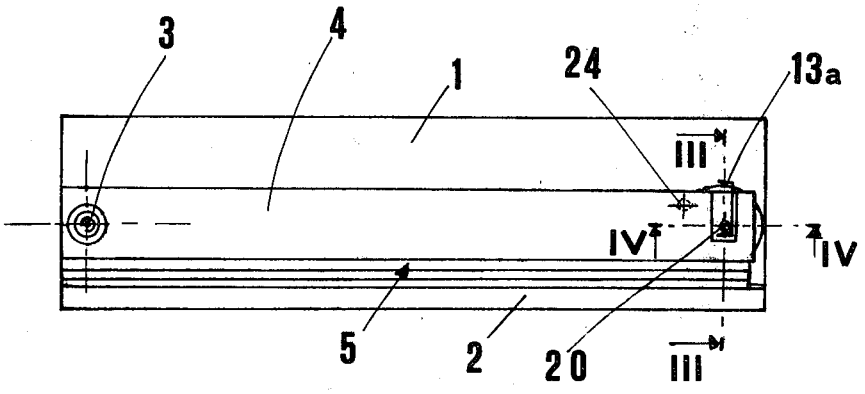
FIG. 1 is a planar view of the upper part of the piece of furniture provided with the device according to the present invention, the panel being in the closed position.
Figure 2:
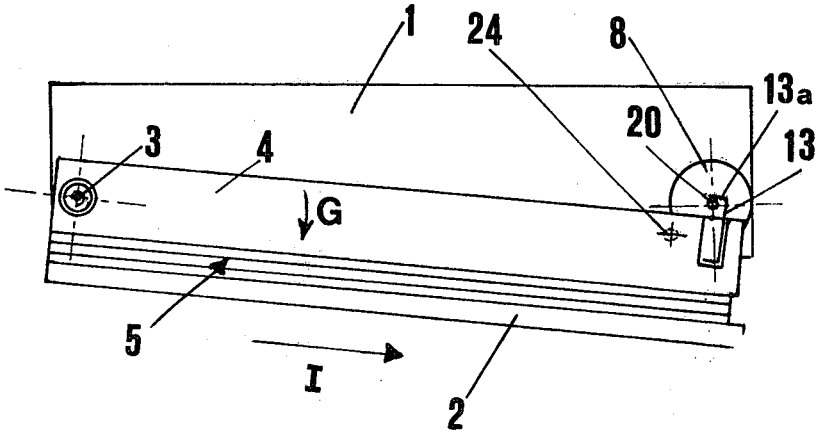
FIG. 2 is the embodiment of FIG. 1 with the panel in the open position ready for sliding.

The figures represent the upper part of the device, the lower one being identical and being arranged symmetrically to the upper part. Referring particularly to FIGS. 1 and 2, numeral 1 designates the upper cross-bar of the piece of furniture to which the sliding panel 2 is applied.

On the upper face of cross-bar 1 is hinged at one end, by means of pin 3, a metallic tubular section 4 to which is applied by known means a known telescopic sliding guide 5, constituted by three reciprocally sliding elements, one of the external elements being fixed to the section 4, while to the other is fixed the panel 2 by any known means.

Figure 6:
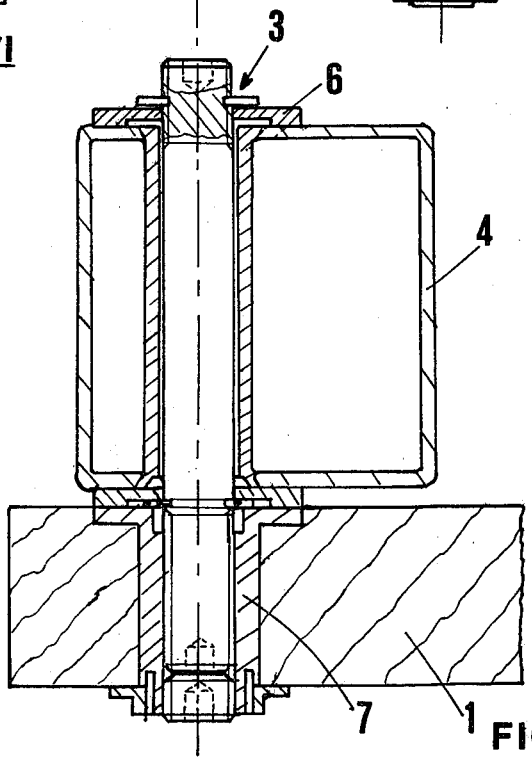
FIG. 6 is a view of the device according to section VI—VI of FIG. 5.

FIG. 6 illustrates in more detail the manner of hinging the section 4 and the interposition of bushings 6 and 7, the latter being threaded if desired for the adjustment of the position of pin 3.

Figure 3:
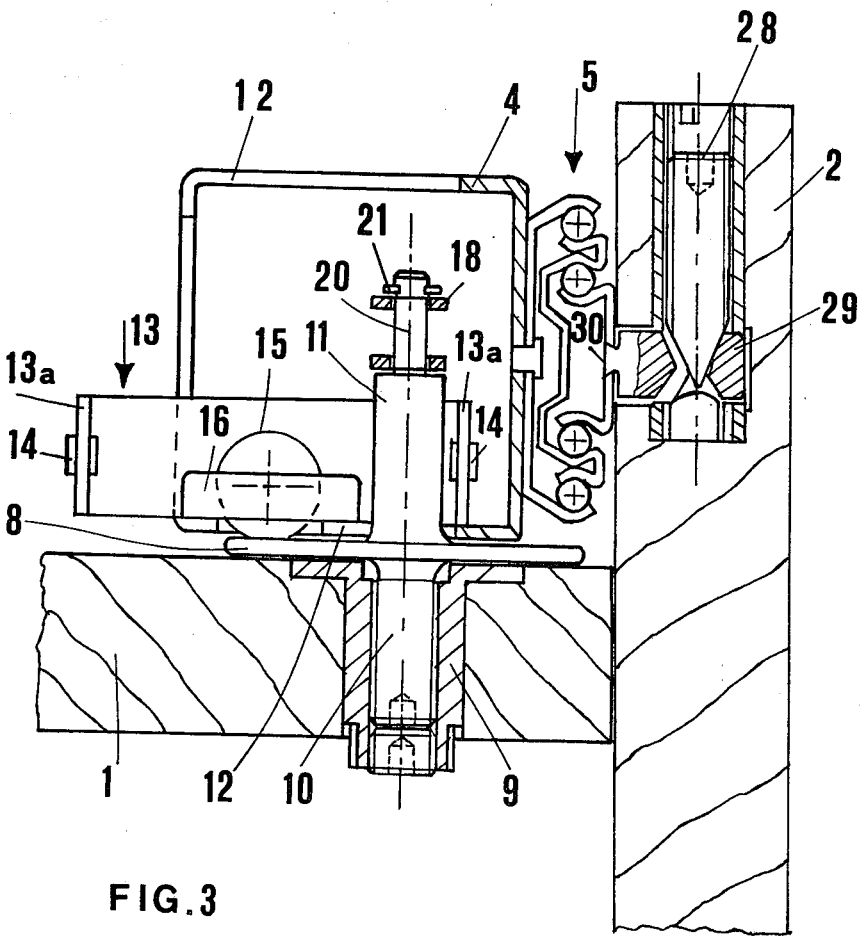
FIG. 3 is a view of the device according to section III—III of FIG. 1, and illustrating the structure of a typical portion of the device as connected at the upper part of the piece of furniture.
Figure 3A:
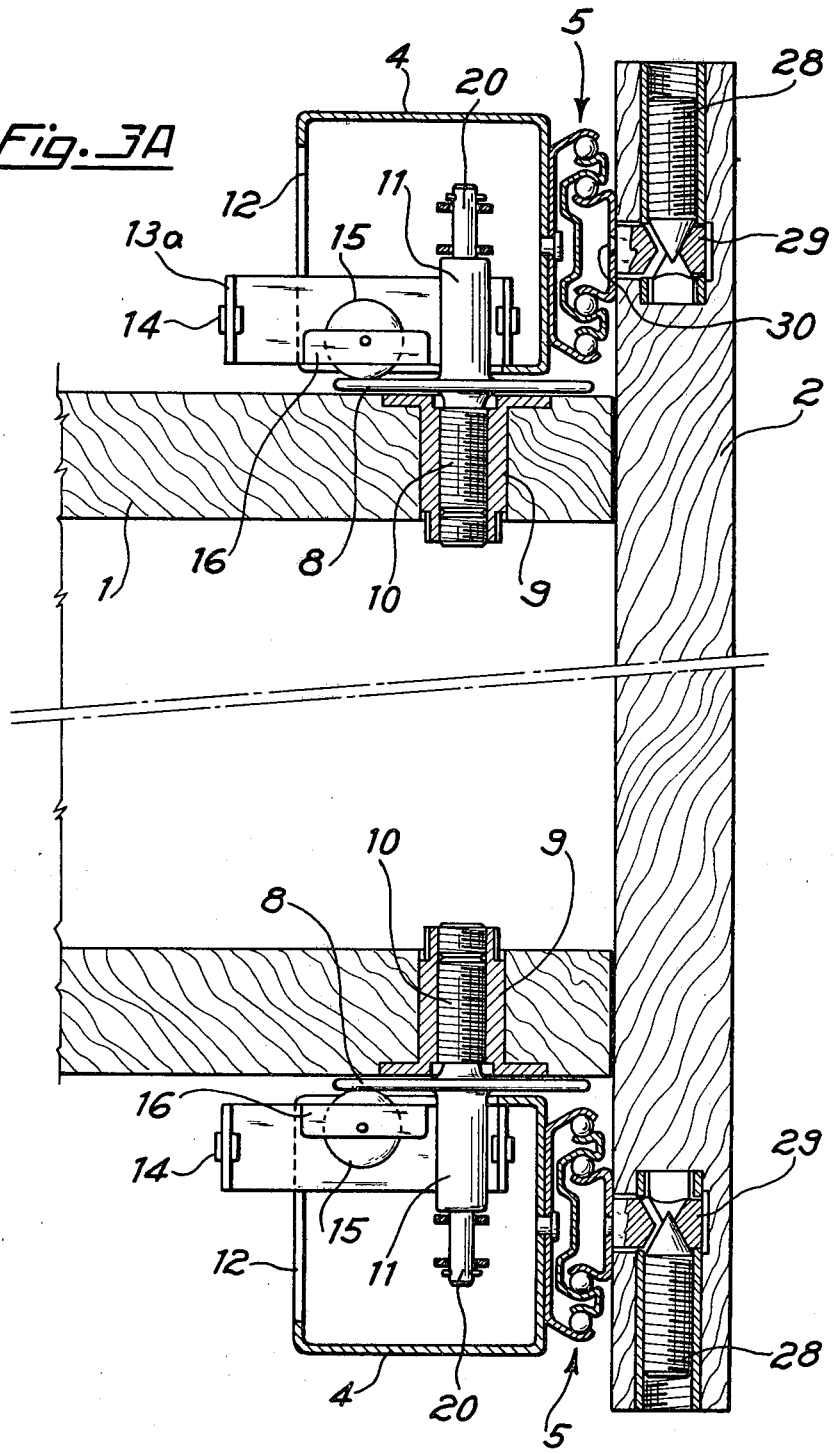
FIG. 3A is a view of the device similar to FIG. 3, but showing a more complete view illustrating the upper and lower portions of the device which cooperate to carry a typical sliding panel.
Figure 4:
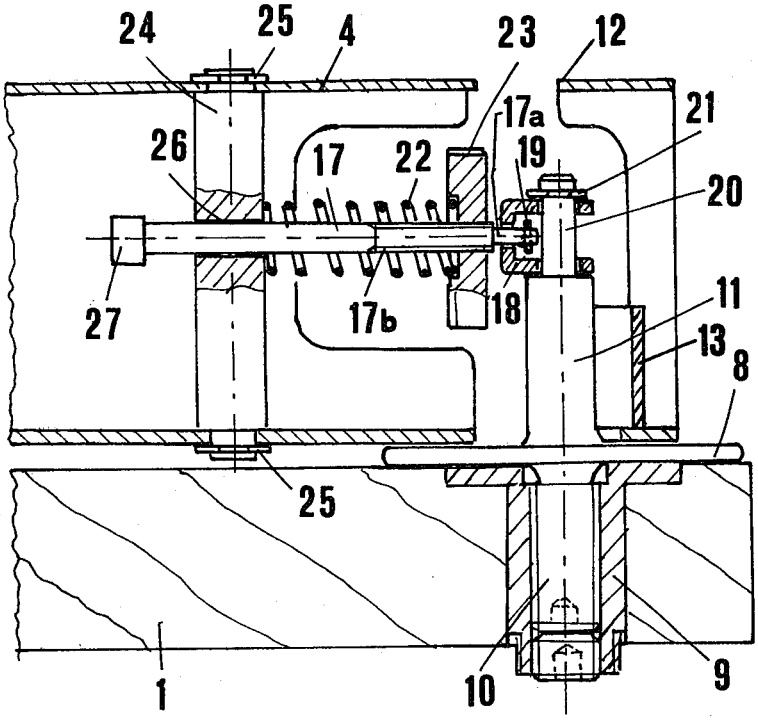
FIG. 4 is a view of the device according to section IV—IV of FIG. 1.
Figure 5:
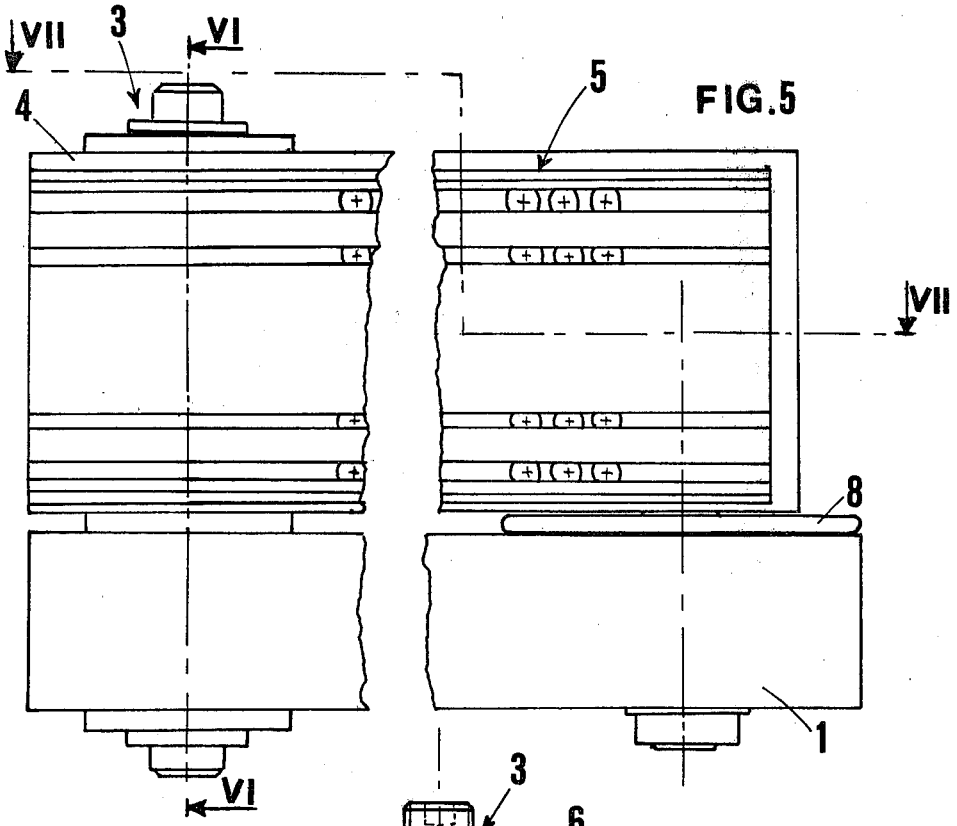
FIG. 5 is a front view showing the device according to the present invention.
Figure 7:
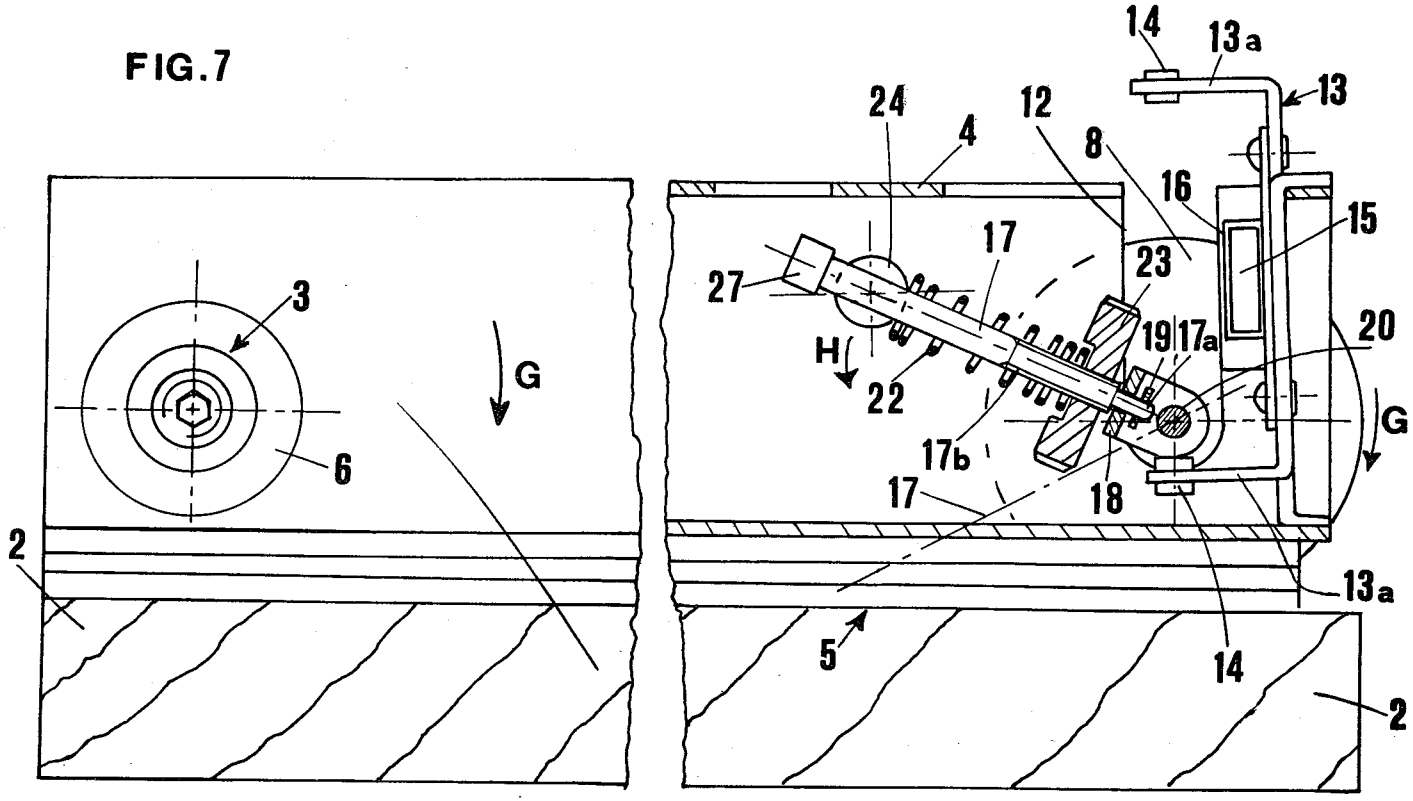
FIG. 7 is a view of the device according to section VII—VII of FIG. 5.

In FIGS. 3, 4 and 7 are represented the means associated to tubular element 4, at the end opposite to the end of the hinge for the purpose of permitting and regulating the rotations of element 4 so that panel 2 is carried in the two positions represented in FIGS. 1 and 2. These means comprise a metallic plate 8 fixed to the upper cross-bar 1 by means of a bushing 9, in which a first pin 10 is screwed, plate 8 being provided with this pin for the adjustment of its height. Plate 8, on the opposite face, is provided with a second pin 11 capable of achieving a stop of the rotations of section 4. These rotations are possible because section 4 is provided with a slot 12 in which pin 11 can slide. The amplitude of the rotation allowed to section 4, is limited by a member 13 having the shape of a C, fixed at the end of section 4. The arms 13*a* are provided with small pieces of rubber 14 which stop the motion of rotation of section 4. A ball bearing 15 rotatably set by the same C-shaped member 13 by means of a stop plate 16, avoids the slipping of section 4 on the plate 8 forming a sliding roller.

The device according to the present invention also comprises elastic return means capable of retaining panel 2 in the open and closed positions. These means comprise a small shaft 17 perpendicular to pin 11 and connected with the latter by means of a second C-shaped member 18. The end 17*a* of the small shaft 17 is inserted in an opening of the vertical shaft of member 18, and retained within this opening for example by means of retainer 19. The member 18 which has a C-shape is freely turning on a part 20, which has a diameter shorter than the second pin 11, and is retained on the latter by means of retainer 21.

On the small shaft 17 is disposed spring 22, which always appears compressed for any position of tubular section 4. Spring 22 co-operates at one end with a nut 23, which can be screwed on a threaded portion 17*b* of the small shaft 17, and, at the other end, with a pin 24, set in the tubular section 4, turning around its own longitudinal axis, being fixed to said section 4 by means of retainers 25, which permit these rotations.

As it appears particularly from FIGS. 4 and 7, pin 24 presents, in a substantially central zone, an opening 26, in which the small shaft 17 is slidingly inserted. The small shaft 17 presents at the projecting end of pin 24 a portion 27 of greater diameter.

According to one of the features of the device according to the present invention, and particularly with reference to FIGS. 1, 2 and 7, pin 24 is placed near the side of the tubular section 4, opposite with respect to the side to which panel 2 is fixed. Pin 24, when the panel is closed, as shown in FIG. 1, is offset with respect to the straight line which joins pin 3 with part 20 of pin 11. However, when the panel is opened as shown in FIG. 2, it is offset with respect to the same straight line on the opposite side. In this manner in the closed position, spring 22, which tends to expand, will press from one side on pin 24 and from the other side against nut 23, retaining the section 4 in the closed position, which is illustrated in FIG. 7.

When the panel is to be brought to the open position, section 4 is turned according to the direction of arrow G, to which corresponds a counter-clockwise rotation according to arrow H of the small shaft 17 around portion 20 of pin 11.

It is evident that the complete rotation of section 4, i.e. the rotation of the small shaft 17, may be subdivided in two successive phases; in the first one spring 22 is compressed until the pins 3 and 24 and portion 20 are aligned, and a second phase, in which pin 24 is brought beyond the above mentioned straight line which joins pin 3 with the portion 20, in which spring 22 will expand again. This position is schematically indicated by the dashed line with respect to the small shaft 17 in FIG. 7. Even in the latter position spring 22 is capable of retaining panel 2 in the open position. Clearly, a limited force will be required to open and shut the panel but it will secure a stability of the position of the panel particularly as with respect to its closure.

When the panel is open, i.e. in the position of FIG. 2, it may easily slide according to the direction of arrow I of FIG. 2, and in this manner the space which was closed is opened. Then the panel may be brought back to the closed position by sliding according to the direction illustrated and subsequent rotation around pin 20.

In FIG. 3 is represented by way of example, the manner in which panel 2 is fixed to the sliding telescopic guide 5. A stop nut 28 inserted in a longitudinal opening of panel 2 is capable of stopping an element 29 disposed within a transversal opening of panel 2, which is provided with a flanged extension 30 fixed to the external element of guide 5. Obviously, any number of stop elements 29 may be used depending on the length of panel 2.

The portion of the bearing device according to the present invention placed in the lower part of the piece of furniture is not illustrated because it is substantially identical to the upper portion. Obviously, only the reciprocal position of the various elements will be different. The configuration will be substantially as shown in FIG. 3, in which pin 10, instead of being placed in the lower part, is placed in the upper part and is integral with pin 11 placed in this way. The lower cross-bar of the piece of furniture is fixed in this manner to the pin 10. Finally it is evident that what has been described hereinabove about a panel which may be opened clockwise, is also applicable to a panel which is opened counter-clockwise. It is clear that variations and/or modifications may be made in the bearing device of the sliding panel described hereinabove, to enclose any space without departing from the scope of this invention.

From the foregoing, it can be seen that basically the invention provides a certain improvement in a piece of furniture of the type having an opening and a sliding panel (2) supported for movement relative to such opening, and movable between an open and a closed position. Basically, this improvement comprises at least one elongated section (4) pivotally connected as at (3) which is one end portion to the furniture and extending along the opening thereof; pivot movement limiter means (13,14) carried at the opposite end portion of section (4) and disposing to engage a stop member (11) secured to the furniture to correspondingly limit the pivotal movement of section (4) relative to the furniture; and sliding guide means (5) connected to section (4) and connected to the sliding panel (2) to allow same to move slidably relative to section (4) and the furniture.

What is claimed is:

1. A bearing device for sliding panels particularly for furniture, which comprises: two sections (4) fixed at one end thereof at the upper cross-bar and at the other end thereof at the lower cross-bar of the piece of furniture respectively, by hinge means; a telescopic sliding guide (5) fixed to each of said sections (4) on the side where the panel (2) is located, said panel being slidably fixed to said telescopic guide; means, (11, 13) for stopping the rotations of the sections, placed substantially at the end of said sections which is opposite to the hinge means; elastic return means (22) connected at one end thereof to a fixed portion (20) of the piece of furniture and, at the other end, to a pin (24) set in said sections (4), said elastic means being adapted to place and retain the panel (2) in its closed and open positions respectively, wherein the elastic means comprise a spring (22), a small shaft (17) supporting said spring, said shaft being rotatably set in a plane substantially parallel to the plane of rotation of the sections (4), said shaft having one end rotatively connected around a portion (20) of a pin (11), perpendicular to the plane of rotation of said sections (4), the other end being slidingly set within a pin (24), parallel to said pin (11), said pin (11) being rotatively set around its longitudinal axis in said sections (4).

2. A bearing device for sliding panels according to, claim 1 wherein said hinge means comprise a pin (3) and in the open and closed positions respectively of said panels (2), said pin (24) is offset on one of the two opposite sides of the straight line which joins said pin (11) to said hinge pin (3) of said sections (4).

3. A bearing device for sliding panels according to claim 1 in which on the small shaft (17) is screwed a nut (23) adapted to keep said spring (22) pressed against said pin (24).

4. A bearing device for sliding panels according to claim 1, in which a rotatable bearing (15) is fixed on said sections (4), said device comprising a plate (8) fixed to the upper cross-bar of said piece of furniture, and said rotatable bearing (15) is adapted to keep said section (4) detached from said plate (8).

5. The device according to claim 1 wherein said sections (4) are tubular metallic members.

6. The device according to claim 1 wherein said panels are provided with a longitudinal orifice and a transversal orifice and said telescopic guide (5) comprises blocking means (28) inserted in said longitudinal orifice, and members (29) inserted in said transversal orifice, said blocking means (28) being adapted to block said members (29).

* * * * *